US008109415B2

(12) United States Patent
Tu

(10) Patent No.: US 8,109,415 B2
(45) Date of Patent: Feb. 7, 2012

(54) FOAM PUMP

(76) Inventor: Xufeng Tu, Zhejiang (CN)

( * ) Notice: Subject to any disclaimer, the term of this patent is extended or adjusted under 35 U.S.C. 154(b) by 669 days.

(21) Appl. No.: 12/017,622

(22) Filed: Jan. 22, 2008

(65) Prior Publication Data

US 2009/0039111 A1 Feb. 12, 2009

(30) Foreign Application Priority Data

Aug. 10, 2007 (CN) ..... 2007 2 0113219 U

(51) Int. Cl.
*B67D 7/76* (2010.01)

(52) U.S. Cl. ..... 222/190; 222/145.5; 222/189.11; 222/321.7; 222/321.9

(58) Field of Classification Search ..... 22/190; 222/190, 145.5, 145.6, 189.09, 189.11, 321.7, 222/321.9, 481.5
See application file for complete search history.

(56) References Cited

U.S. PATENT DOCUMENTS

| | | | | |
|---|---|---|---|---|
| 6,536,629 | B2 * | 3/2003 | van der Heijden | 222/190 |
| 6,612,468 | B2 * | 9/2003 | Pritchett et al. | 222/190 |
| 6,840,408 | B1 * | 1/2005 | Foster et al. | 222/190 |
| 6,923,346 | B2 * | 8/2005 | Foster et al. | 222/190 |
| 7,004,356 | B1 * | 2/2006 | Sayers | 222/190 |
| 7,147,133 | B2 * | 12/2006 | Brouwer et al. | 222/190 |
| 2002/0056730 | A1 * | 5/2002 | van de Heijden | 222/190 |
| 2002/0070238 | A1 * | 6/2002 | Pritchett et al. | 222/189.11 |
| 2004/0069807 | A1 * | 4/2004 | Brouwer et al. | 222/175 |
| 2005/0115988 | A1 * | 6/2005 | Law et al. | 222/190 |
| 2007/0045350 | A1 * | 3/2007 | Lin | 222/321.9 |
| 2007/0119864 | A1 * | 5/2007 | Tsai | 222/190 |

* cited by examiner

*Primary Examiner* — Frederick C. Nicolas
(74) *Attorney, Agent, or Firm* — Haugen Law Firm PLLP

(57) ABSTRACT

A foam pump includes a pump body, a large piston, large piston rod, a small piston, a small piston rod, a over cap and a foaming mesh. The large piston rod is equipped with a one-way valve connected with an air cavity to enable one-way air inlet from the air cavity to a gas-liquid mixing chamber. The mixed air and liquid forms a dischargeable foam.

3 Claims, 6 Drawing Sheets

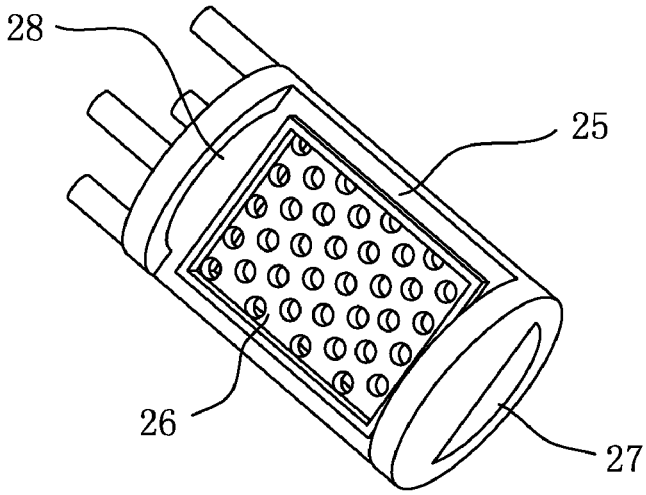
Fig. 5
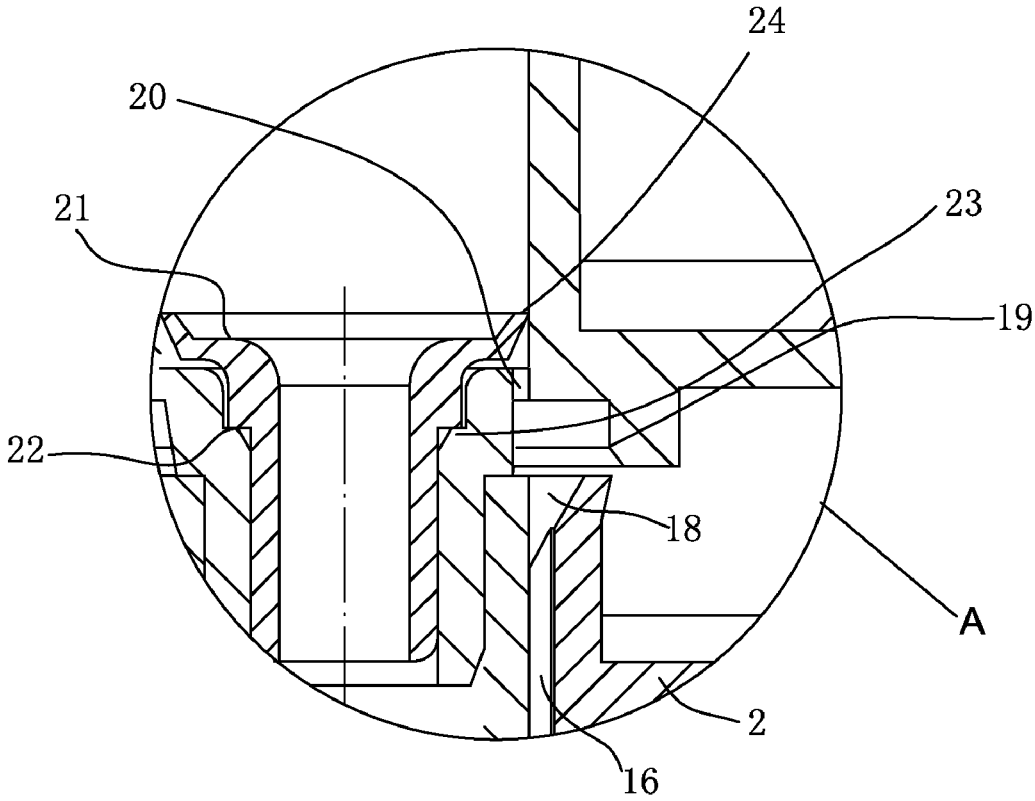
Fg. 6

FOAM PUMP

CROSS REFERENCE TO THE RELATED PATENT APPLICATION

This application claims the priority of the Chinese patent application No. 200720113219.8 with filing date of Aug. 10, 2007.

FIELD OF THE INVENTION

This utility patent relates to a kind of foam pump.

BACKGROUND OF THE INVENTION

With the continuous improvement of people's living standard, foam pump has been widely used in daily cosmetic, medicines and other fields, therefore, scientists and technicians keep making new technological improvements for it. For example, Chinese patent no. 200620109913.8 "foam pump", describes a joint, a reticulated foam meshwork mounted in the liquid inlet pipe of the joint, a screw thread whose upper part is equipped in the joint and engaged with the joint, a body whose upper opening fixed with said thread and a glass ball equipped at the liquid inlet of the body. The body includes a hollow upper pole in the thread with a shaped section, and the upper opening is located in the liquid outlet pipe of the joint and is engaged with it. The lower opening is equipped with a fastener, and includes a hollow lower pole in the thread and the valve body. The upper opening is located in the upper pole and is engaged with it and the lower opening is located in the liquid inlet pipe of the valve body. The pump further includes a spring enclosing the lower pole, and a cylinder piston in the thread and the valve body. The upper opening is equipped in the fastener of the upper pole, while the outer wall of the lower opening contacts and engages with the inner wall of the valve. The pump includes an auxiliary pole in the valve body and the lower pole, which is equipped at the lower opening of the lower pole and can be used for opening or closing the lower opening of the lower pole. The liquid piston is mounted outside the auxiliary pole. Problematically, air admission is realized through the interval cooperation of the upper pole and the lower pole. Therefore, this structure has the defect that if the interval is too large, no one-way valve function can be achieved and if the interval is too small, it is possible to be blocked, leading to poor air admission effect. The compression spring is directly supported between the valve body and the lower pole, making the foam pump too high and incontinent for installation and operation. The foaming structure of such reference is too simple and the foaming effect is not ideal, while the piston structure is too complicated and inconvenient for manufacture and operation. The above indicates that further improvements for this kind of foam valve are required.

SUMMARY OF THE INVENTION

This utility patent is to provide a kind of foam pump with simple structure and fine air inlet effect and it is practical and easily assembled.

The technical solution adopted by this utility patent is: A foam pump consisting of a pump body, a large piston, large piston rod, a small piston, a small piston rod, a over cap and a foaming mesh, which is featured by that said large piston rod is equipped with a one-way valve connected with an air cavity of said large piston and that said one-way valve adopts sleeve-shaped valve plate made of elastic materials mounted on the fixing base on the large piston rod with a stepped surface and that the upper part of said valve plate adopts conical sealing surface with increasing diameter for sealing together with the connecting hole on said large piston rod, said connecting hole connecting a gas-and-liquid mixing cavity in the large piston rod and said air cavity of said large piston.

As an improvement, said connecting hole(s) is (are) equipped below the conical sealing surface of the valve plate and are evenly circumferentially distributed (if multiple) for air inlet.

As a further improvement, the lower part of said pump body forms a U-shape ring groove out of the section, said compression spring is equipped between the ring groove and the supporting ring at the end of the small piston rod. To shorten the height of said foam pump for actual application.

As a further improvement, said large piston rod is equipped with a reticulated foam base, which has reticulated foam meshwork at the center, the left and right parts of said reticulated foam base are the lower inlet and upper outlet respectively. Two vertical sharp curves greatly enhance the foaming effect.

As a further improvement, a piece of upper reticulated foam meshwork and a piece of lower reticulated foam meshwork are respectively equipped between the upper end of said large piston rod and said over cap with a spacer, which further improves the foaming effect.

As a further improvement, the nozzle of said over cap forms a foaming hole with nozzle, results in foaming the air-liquid mixture a fourth time, thereby improving the foaming effect.

As another improvement, a one-way valve structure is equipped between said large piston and said large piston rod, the upper part of the valve membrane inside said large piston is in conical sealing surface engaged with the conical opening of the lower end of said large piston rod, the lower end of said connecting hole is equipped in said conical opening, the inner periphery of the valve membrane inside said large piston forms a through groove connecting the air cavity of said large piston to the outside, which is simple and practical.

As a very useful improvement, said large piston adopts double-valve membrane structure, the inner valve membrane and the outer valve membrane constitute a sleeve and sections of said inner valve and said outer valve are so connected as to approximately form an "h", which simplifies the structure of the piston, making the piston strong and practical, wearable an with fine sealing effect.

Finally, said pump body is connected with the large cap by screw thread.

Compared with existing technologies, this utility has the following advantages: the large piston rod is equipped with a one-way valve to connect with the air cavity of the large piston, the one-way valve is simple and practical, with fine air inlet effect and easily assembled and used, it adopts U-shape groove supporting spring, which can shorten the height and broaden the range of application of the pump, besides, it adopts the multiple-time foaming structure, which improves the foaming effect, simplifies the structure of the piston, improves the practicality, provides more reasonable integrated structure, works more reliable and has better foaming effect.

BRIEF DESCRIPTION OF THE DRAWINGS

FIG. 5 is a structural representation of the reticulated foam base;

FIG. 6 is a zoom-in view of part A in FIG. 1;

DETAIL DESCRIPTION OF THE INVENTION

Figure 1:
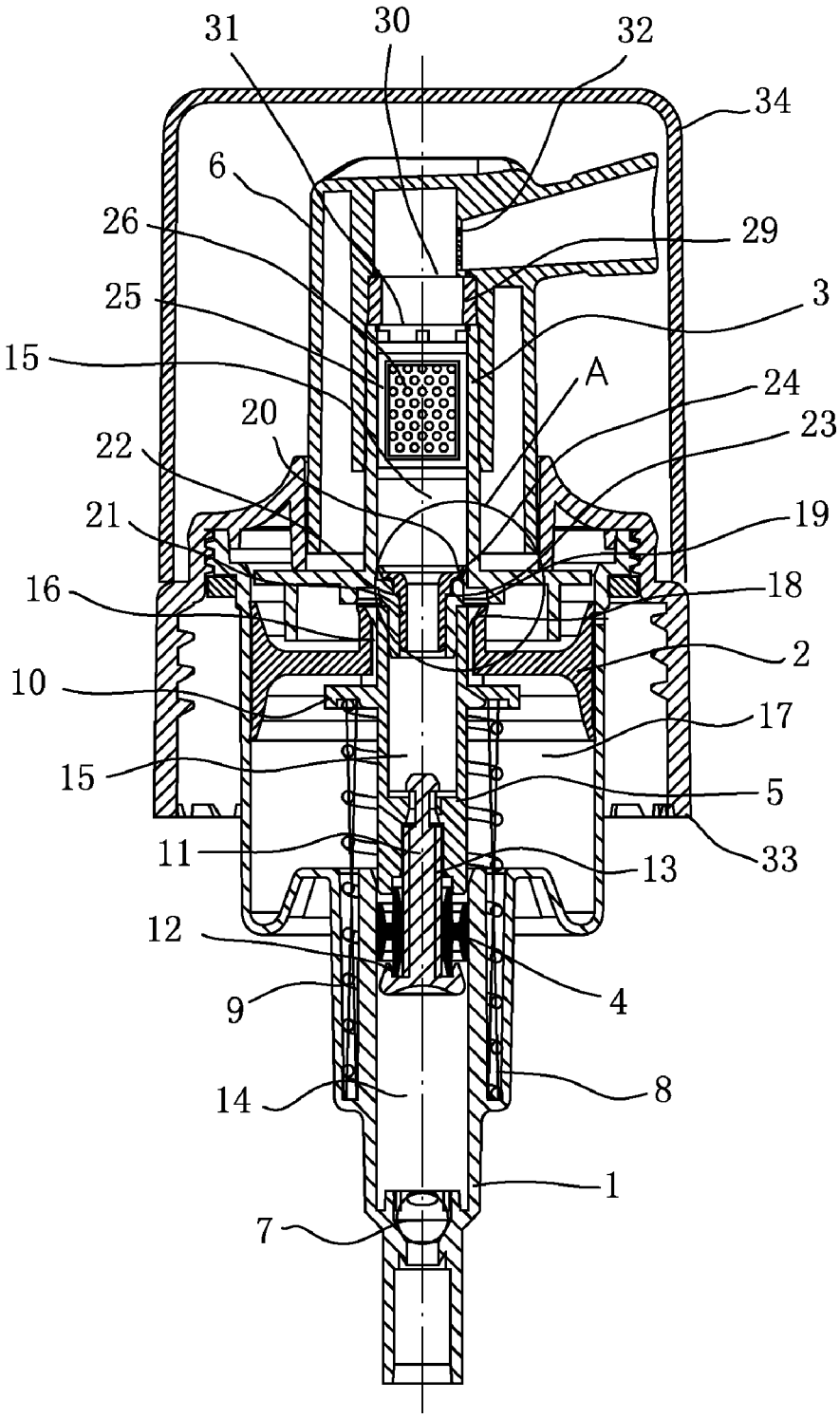
FIG. 1 is a structural representation of the foam pump of this utility.
Figure 2:
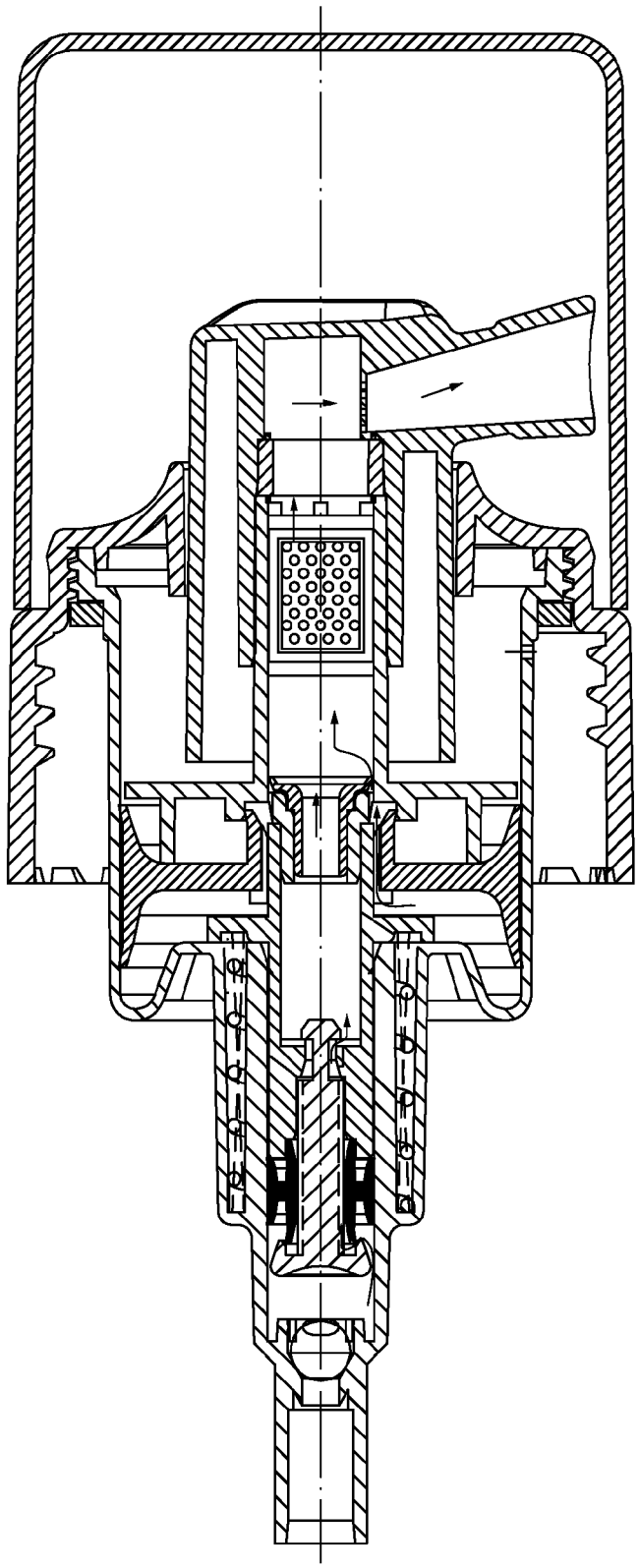
FIG. 2 is a structural representation of the foam pump of this utility (spring pressed)
Figure 3:
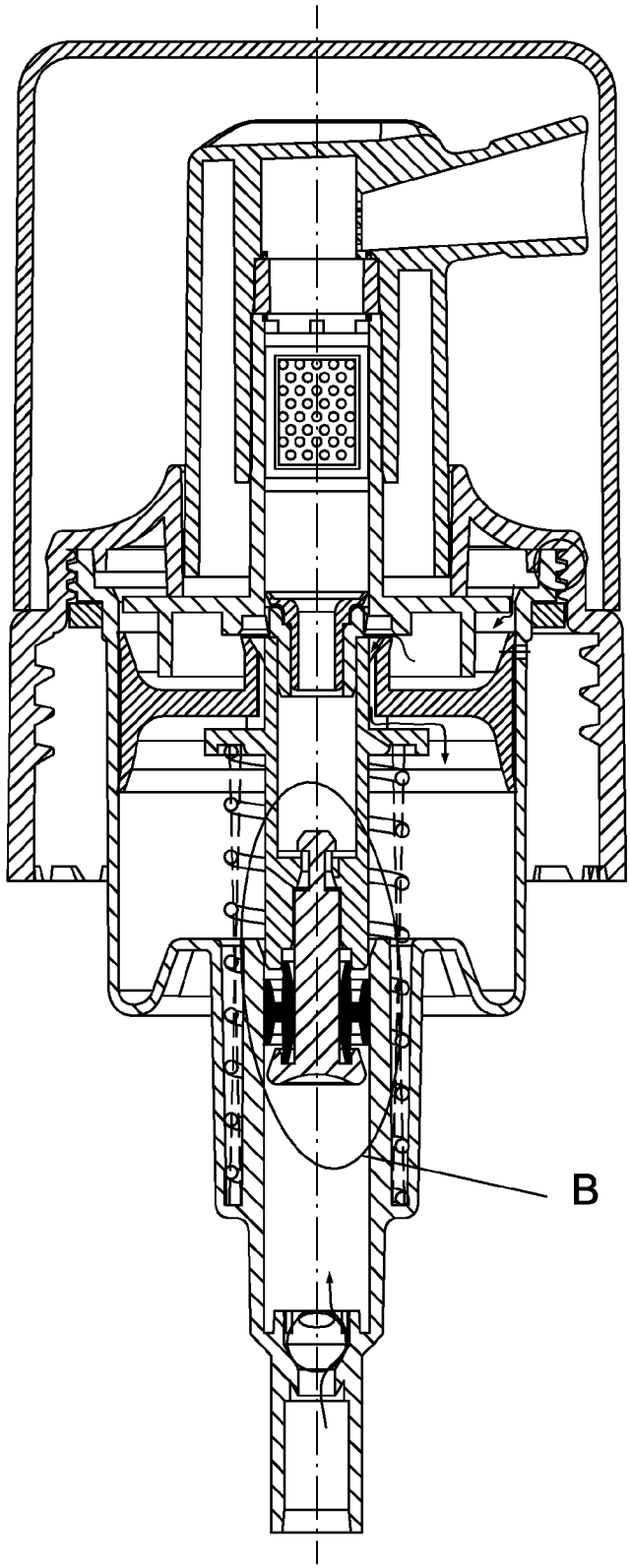
FIG. 3 is a structural representation of the foam pump of this utility (spring released)
Figure 4:
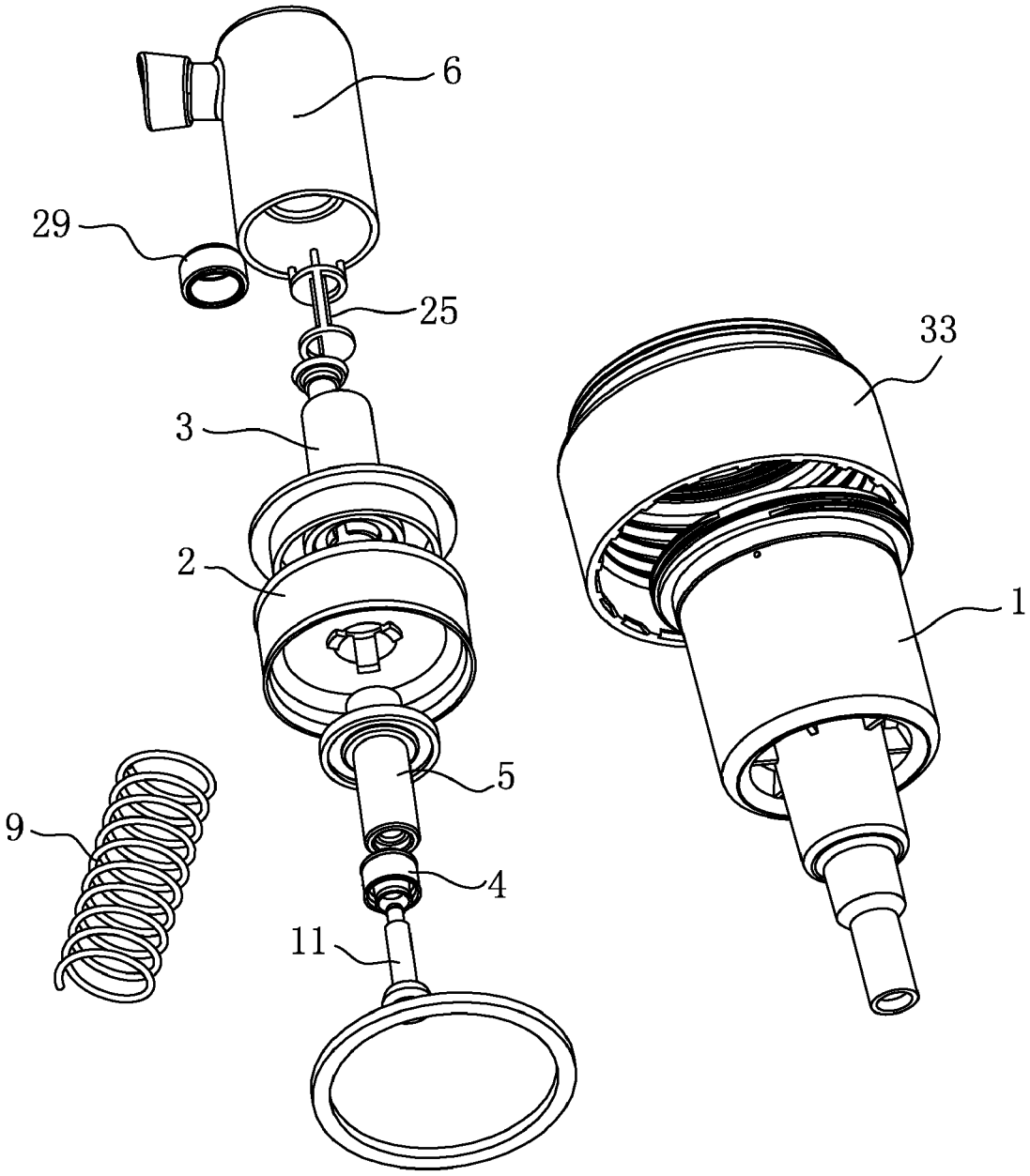
FIG. 4 is an exploded view of the foam pump of this utility model.
Figure 7:
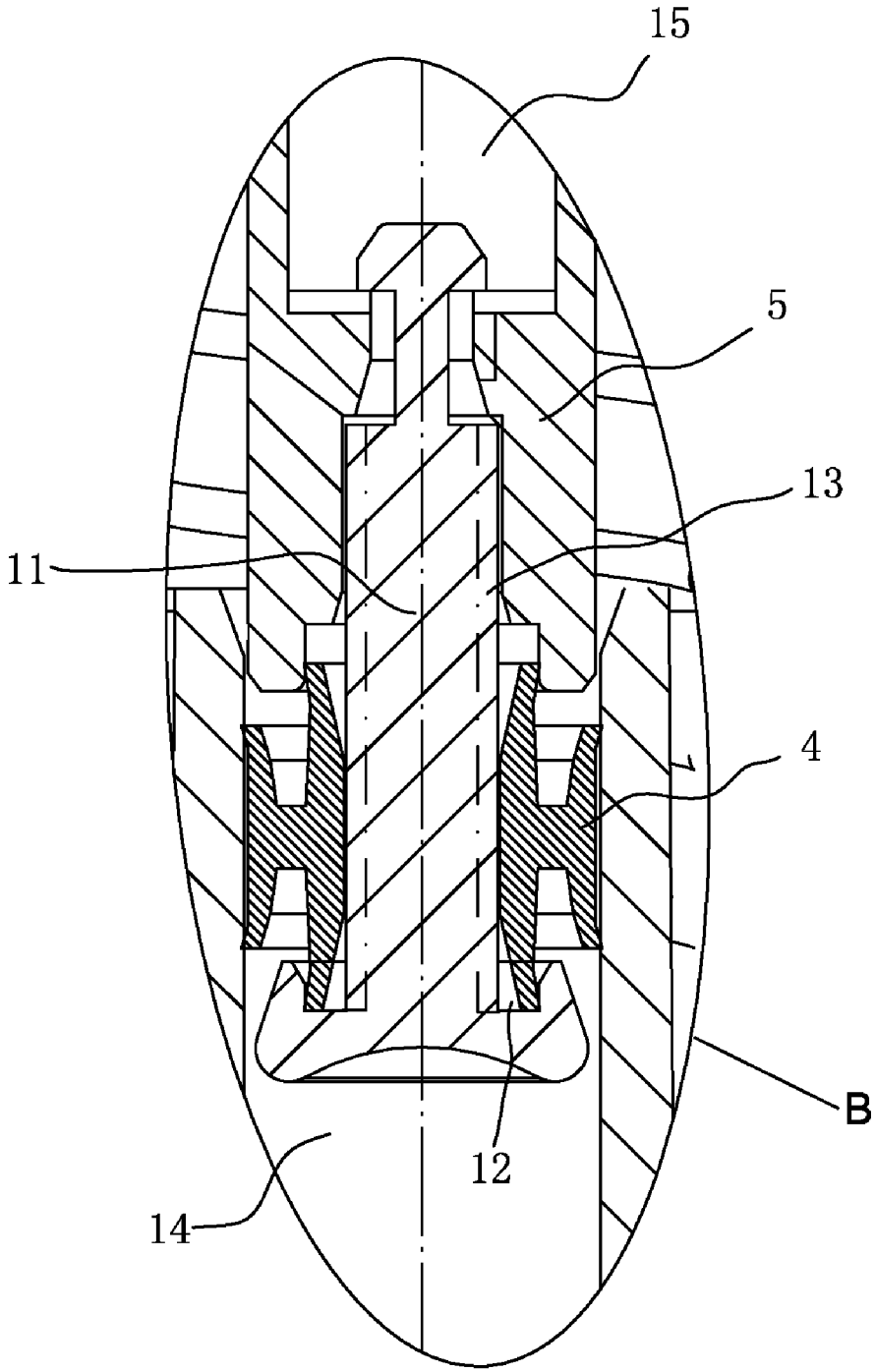
FIG. 7 is a zoom-in view of part B in FIG. 3.

Now, description will be given below of an embodiment of this utility with reference to the accompanying drawings.

As shown in the figure, a kind of foam pump comprising a pump body 1, a large piston 2, a large piston rod 3, a small piston 4, a small piston rod 5, a over cap 6, a reticulated foam base and some other main parts, the pump body 1 is equipped with a sucker at the lower end, a glass ball 7 is equipped inside the upper part of the sucker, constituting a one-way valve, and at the same time, a ring groove 8 forms on the lower part of the pump body 1 with a U-shape section, a compression spring 9 is equipped between the ring groove 8 and the supporting ring 10 at the end of the small piston rod. And the connecting hole at the lower end of the small piston rod 5 is connected to the small piston base 11, a small piston 4 is slidably fixed at the center of the small piston base 11, the small piston 4 adopts double-valve membrane structure, the lower end of the larger valve membrane engages with the ring groove 12 on the small piston base 11, which is provided with conical surface on the flange. A shallow groove 13 for connecting the liquid cavity 14 at the lower part to the air-liquid mixing cavity 15 at the upper part is on the surface of the small piston base 11. A large piston 2 is equipped on the surface of the supporting ring 10 of the small piston rod that also adopts double-valve membrane structure, the inner valve membrane and the outer valve membrane constitute a sleeve and sections of said inner valve membrane and said outer valve membrane are so connected as to approximately form an "h", the inner periphery of the valve membrane inside the large piston 2 forms a through groove 16 connecting the air cavity 17 of said large piston to the outside. And a one-way valve structure forms between the large piston 2 and the large piston rod 5, that is, the upper part of the valve membrane inside the large piston 2 becomes a conical sealing surface 18 engaged with the conical opening 19 at the lower part of the large piston rod, the lower end of the connecting hole 20 is equipped in this conical opening. A one-way valve is also provided between air-liquid mixing cavity 15 of the large piston rod and the air cavity 17 of the large piston, moreover the one-way valve body adopts a sleeve-shape valve plate 21 make of elastic material like silica gel, the valve plate 21 is provided with a stepped surface 22, with which the valve plate 21 can be mounted onto the fixing base 23 in the large piston rod. Furthermore, the diameter of the conical sealing surface 24 at the upper end of the valve plate 21 increases gradually, while the connecting hole 20 is equipped below the conical sealing surface of the valve plate, the number of which can be one or more. In the case of multiple connecting holes 20, they are distributed evenly circumferentially to connect the air-liquid mixing cavity 15 in the large piston rod and the air cavity 17 of the large piston. Thus, the conical sealing surface 24 at the upper end of the valve plate can be engaged with the connecting hole(s) 20 of the large piston rod to constitute the one-way valve. The reticulated foam base 25 is equipped at the middle of the large piston rod 3, the vertical plane at the center of the reticulated foam base 25 is the reticulated foam meshwork 26, which separate the reticulated foam base in two parts (left and right), while the left and right parts of the reticulated foam base are respectively the lower inlet 27 and the upper outlet 28 to allow sharp turn of airflow when passing the reticulated foam meshwork, which can greatly improve the foaming effect of the reticulated foam meshwork. Furthermore, an upper reticulated foam meshwork 30 and a lower reticulated foam meshwork 31 are respectively equipped between the upper end of said large piston rod and said over cap with a spacer 29 to achieve the foaming effects of the $2^{nd}$ and the $3^{rd}$ times. The nozzle of said over cap forms a foaming hole 32 with nozzle over cap to achieve the foaming effect of the 4th time. The over cap 6 is mounted on the large piston rod 3, the lower end of the over cap 6 tensibly inserted into the center hole of the large cap 33, which is connected with the pump body 1 by whorl and then connect with the bottle opening of the outer shell of the sprayer by whorl to constitute a packing container with the foam pump, a transparent shield 34 covers the large cap 33.

The principles and procedure of operation of this utility are as follows: when you press down the over cap 6 by hand to drive the large piston rod 3 move downward, because the conical sealing surface at the upper end of the valve membrane inside the large piston 2 engages with the conical opening at the lower end of the large piston rod 3 to achieve a airtight condition, and at the same time, with the pushing of the lower end of the large piston rod 3, the large piston 2 presses the air cavity 17 to increase the air pressure, and then the air in the air cavity 17 pushes open the conical sealing surface 24 at the upper end of the valve plate 21 through the through groove 16 of the large piston and the connecting hole 20 and enters the air-liquid mixing cavity 15 in the large piston rod so as to bring the mixture of air and liquid to pass the reticulated foam base 25. The lower reticulated foam meshwork 30, the upper reticulated foam meshwork 31 and the foaming hole 32 at the nozzle of the over cap in order, after four times of foaming, the mixture is sprayed out from the foaming hole at the nozzle of the over cap, and with the thrust of the large piston rod 3, the small piston rod 5 overcomes the elastic force of the compression spring 9 and move downwards. Due to the resistance between the small piston and the inner wall of the pump body, the small piston 4 starts lost motion at the beginning and slides relative to the small piston base 11, therefore, there cannot be contact sealing between the lower end of the small piston 4 and the ring groove 12 on the small piston base. Furthermore, the small piston 4 moves downwards, which increases the pressure in the liquid cavity 14 of the pump body, the glass ball 7 encapsulates the sucker to prevent the liquid below from flowing in, and the liquid in the liquid cavity 14, driven by the airflow, enters the air-liquid mixing cavity 15 of the small piston rod through the shallow groove 13 on the surface of the small piston base to be mixed with the air from the air cavity 17 to form the air-liquid mixture to prepare for the next cycle. Release of the over cap 6 causes the small piston rod 5 to move upwards with the elastic force of the compression spring 9 to drive the large piston rod 3 move upwards. The resistance between the small piston 4 and the inner wall of the pump body is lost motion at the beginning, which slides relative to the small piston base 11 until the contact sealing between the lower end of the small piston 4 and the ring groove 12 on the small piston base is realized again. Furthermore, the small piston 4 moves upwards, which increases the volume of the liquid cavity 14 in the pump body and decreases the pressure in the air cavity, so the glass ball 7 cannot encapsulate the sucker, thereby allowing the liquid below to enter the liquid cavity 14 while preventing the liquid in the liquid cavity from passing the shallow groove 13 on the surface of the small piston base to enter the air-liquid mixing cavity 15 in the small piston rod. The large piston 2, driven by the small piston rod 5, moves upwards to increase the volume of the air cavity 17 in the pump body and decreases the pressure so as to prevent the conical sealing surface 18 at the upper end of the valve membrane in the large piston 2 from being engaged with the conical opening 19 at the lower end of the large piston rod 3. The conical opening 19 is therefore left open, which allows the external air to enter the air cavity 17 through the groove 16 on the large piston for supplementation to prepare for the next cycle. Spraying is achieved through orderly circular actions.

What is claimed is:

1. A foam pump comprising:

a pump body (1) having a large air cavity (17), a small liquid cavity (14), a U-shape ring groove (8) formed on a bottom of the pump body (1) and a sucker;

a large piston (2) located in the large air cavity (17);

a large piston rod (3) having an air-liquid mixing cavity (15);

a small piston rod (5) having a support ring (10) and a small piston base (11)

a spring (9) equipped between the U-shape ring groove (8) and the supporting ring (10) to force the small piston rod (5) and large piston (2) against the large piston rod (3);

a small piston 4 being slidably disposed on the small piston base (11);

an over cap (6) having a nozzle, and being arranged for pumping actuation of the large piston rod (3);

a first double-valve membrane arrangement including a first valve means being formed between the large piston (2) and the large piston rod (3) comprising an engagement of conical sealing surface (18) with conical opening (19) to open and close access of external air to and connecting hole 16, and a second valve means provided between the air-liquid mixing cavity (15) and the large air cavity (17), the second valve means having a sleeve-shape valve plate (21) having a conical sealing surface (24) made of elastic material for engagement with the large piston rod (3) to open and close access of air from the large air cavity (17) to the air-liquid mixing cavity (15) through a plurality of connecting holes (20);

a second double-valve membrane arrangement including a third valve means being formed by the small between the liquid cavity (14) and the air-liquid mixing cavity (15), wherein a lower end of the small piston (4) engages with a ring groove (12) on the small piston base (11) to open and close access of liquid from the liquid cavity (14) to the air-liquid mixing cavity (15) through groove (13);

a foam means located in the large piston rod (3) and the over cap (6) comprising a reticulated foam base (25) having a reticulated foam meshwork (26) vertically fixed therein between a lower inlet (27) and an upper outlet (28) of the reticulated foam base (25).

2. The foam pump according to claim 1, wherein the nozzle of said over cap forms a foaming hole.

3. The foam pump according to claim 1, further including an upper reticulated foam meshwork (30) and a lower reticulated foam meshwork (31) separated by a spacer and disposed between an upper end of said large piston rod (3) and said over cap (6).

* * * * *

UNITED STATES PATENT AND TRADEMARK OFFICE

CERTIFICATE OF CORRECTION

PATENT NO. : 8,109,415 B2
APPLICATION NO. : 12/017622
DATED : February 7, 2012
INVENTOR(S) : Xufeng Tu It is certified that error appears in the above-identified patent and that said Letters Patent is hereby corrected as shown below:

In Claim 1 at column 6, line 2:
Following "an external air to", please delete "and"

In Claim 1 at column 6, line 12:
Following "formed by the small", please insert --piston (4)--

Signed and Sealed this
Twenty-seventh Day of March, 2012

David J. Kappos

David J. Kappos
*Director of the United States Patent and Trademark Office*